US007318249B2

(12) United States Patent
Lin

(10) Patent No.: US 7,318,249 B2
(45) Date of Patent: Jan. 15, 2008

(54) VACUUM COLLECTOR HAVING SWEEPING DEVICE

(76) Inventor: Kun Yi Lin, No. 104, Lane 145, Song Ju Road, Beitun, Taichung (TW) 406

( * ) Notice: Subject to any disclaimer, the term of this patent is extended or adjusted under 35 U.S.C. 154(b) by 754 days.

(21) Appl. No.: 10/785,358

(22) Filed: Feb. 23, 2004

(65) Prior Publication Data

US 2005/0183233 A1 Aug. 25, 2005

(51) Int. Cl.
*A47L 9/10* (2006.01)
*B01D 41/00* (2006.01)

(52) U.S. Cl. ..... 15/352; 55/299; 55/300

(58) Field of Classification Search ..... None
See application file for complete search history.

(56) References Cited

U.S. PATENT DOCUMENTS 5,159,737 A 11/1992 Kimura et al. ..... 15/314
5,519,915 A 5/1996 Hollowell ..... 15/354
5,814,114 A * 9/1998 Stueble ..... 55/284
6,081,961 A 7/2000 Wang ..... 15/327.2
2005/0000055 A1* 1/2005 Cheng ..... 15/352

* cited by examiner

*Primary Examiner*—David Redding
(74) *Attorney, Agent, or Firm*—Charles E. Baxley

(57) ABSTRACT

A vacuum collector includes a filter housing, a filter member disposed in the filter housing, and a sweeping device disposed in the filter member for sweeping the filter member, to sweep of dirt from the filter member, and to allow the dirt to be removed from the filter member and to be collected. The sweeping device includes one or more flaps rotatably disposed in the filter member with such as a shaft for engaging with the filter member to sweep of dirt from the filter member when the flap is rotated relative to the filter member. One or more resiliently blades may be attached to the flap for engaging with the filter member.

8 Claims, 5 Drawing Sheets

VACUUM COLLECTOR HAVING SWEEPING DEVICE

BACKGROUND OF THE INVENTION

1. Field of the Invention

The present invention relates to a vacuum collector, and more particularly to a vacuum collector having a stirring or sweeping device disposed in a screen filter member, for sweeping dirt from the screen filter member and for allowing the dirt to be easily collected.

2. Description of the Prior Art

Typical vacuum collectors comprise a duct arm or a trunk for directing toward the dust or dirt or fume to be collected, an electric vacuum motor or pump for vacuuming or drawing the dust or dirt or fume into or through the duct arm or the trunk, and a screen filter member attached to one end of the duct arm or the trunk for receiving and collecting the dirt.

For example, U.S. Pat. No. 5,159,737 to Kimura et al. discloses one of the typical vacuum collectors having an adapter duct coupled to a base duct for directing toward the dust or dirt or fume to be collected.

U.S. Pat. No. 5,519,915 to Hollowell discloses another typical vacuum collector attached to a vehicle and having a boom height adjusting device.

U.S. Pat. No. 6,081,961 to Wang discloses a further typical vacuum collector which is portable or movable for being used in house families, etc.

However, in the typical vacuum collectors, the screen filter members are simply attached to one end of the duct arm or the trunk for receiving and collecting the dirt. After use, the dirt or dust may be attached onto the screen filter member, and may thus block the screen filter member, such that the dirt or dust may not be effectively drawn or vacuumed into the screen filter member after working for a period of time.

In the typical vacuum collectors, no stirring or sweeping devices have been provided or disposed in the screen filter member for sweeping dirt from the screen filter member and for allowing the dirt to be easily collected.

The present invention has arisen to mitigate and/or obviate the afore-described disadvantages of the conventional vacuum collectors.

SUMMARY OF THE INVENTION

The primary objective of the present invention is to provide a vacuum collector including a stirring or sweeping device disposed in a screen filter member, for sweeping dirt from the screen filter member and for allowing the dirt to be easily collected.

In accordance with one aspect of the invention, there is provided a vacuum collector comprising a filter housing, a filter member disposed in the filter housing, and means for sweeping the filter member, to sweep of dirt from the filter member, and to allow the dirt to be removed from the filter member and to be collected.

The sweeping means includes at least one flap rotatably disposed in the filter member for engaging with the filter member to sweep of dirt from the filter member when the flap is rotated relative to the filter member. The filter housing includes a shaft rotatably disposed therein to support the flap.

The filter housing includes an upper panel and a bottom bar, the shaft is rotatably disposed between the upper panel and the bar of the filter housing. The filter housing includes two seats attached to the upper panel and the bottom bar, to rotatably support the shaft between the upper panel and the bar of the filter housing.

The shaft preferably includes a non-circular cross section having at least one flat surface formed thereon to solidly attach the flap to the shaft.

One or more blades may further be provided and attached to the flap, for engaging with the filter member. An adjusting device may further be provided for adjusting the blade relative to the flap. The adjusting device includes at least one oblong hole formed in the flap, and a fastener adjustably engaging through the oblong hole of the flap, and engaged with the blade, to adjustably secure the blade to the flap.

A duct may further be provided and the filter housing is disposed on the duct, and a vacuum pump may further be provided and coupled to the duct for drawing the dirt into the filter housing via the duct. A dust bag may further be provided and attached to the duct and disposed below the filter housing to collect the dirt.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
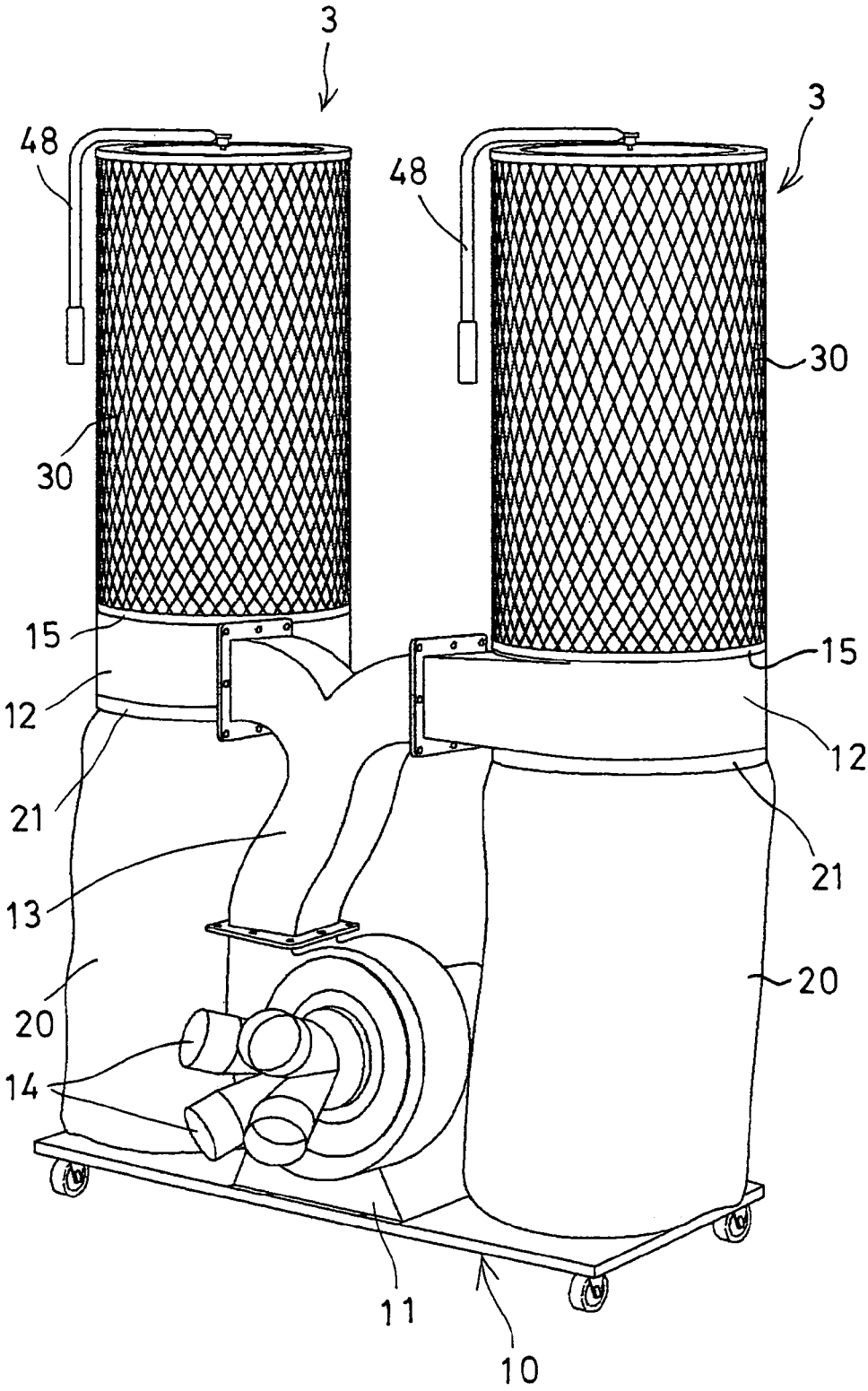
FIG. 1 is a perspective view of a vacuum collector in accordance with the present invention.

Referring to the drawings, and initially to FIG. 1, a vacuum collector in accordance with the present invention comprises a base 10, an electric vacuum motor or pump 11 disposed on the base 10 for vacuuming purposes, one or more, such as two ducts 12 disposed on the base 10 and coupled to the vacuum pump 11 with manifolds 13, and one or more, such as two filter devices 3 attached to the ducts 12 for filtering purposes.

The vacuum pump 11 includes one or more ports 14 for coupling to trunks or duct arms or nozzles (not shown) or the like, and for directing toward the dust or dirt or fume to be collected, in order to vacuum or to drawn the dust or the dirt or the fume through the manifolds 13 and the ducts 12 and then into the filter devices 3 which may be provided for filtering and/or collecting the dust or the dirt.

The filter devices 3 may be attached onto the ducts 12 with such as clamping or retaining rings 15, and preferably disposed above the ducts 12 respectively. One or more, such as two dust bags 20 may further be provided and attached onto the ducts 12 with such as clamping or retaining rings 21, and preferably disposed below the ducts 12 and the filter devices 3 respectively, for collecting the dust or the dirt filtered and/or collected by the filter devices 3.

The present invention is to improve the filter devices 3, and to provide a filter member 31 in a filter housing 30, and a stirring or sweeping device 40 (FIGS. 2 and 4-6) disposed in the filter member 31, for sweeping the dust or the dirt from the filter member 31 and for allowing the dust or the dirt to be easily removed from the filter member 31 and/or to be easily collected within the dust bag 20.

Figure 4:
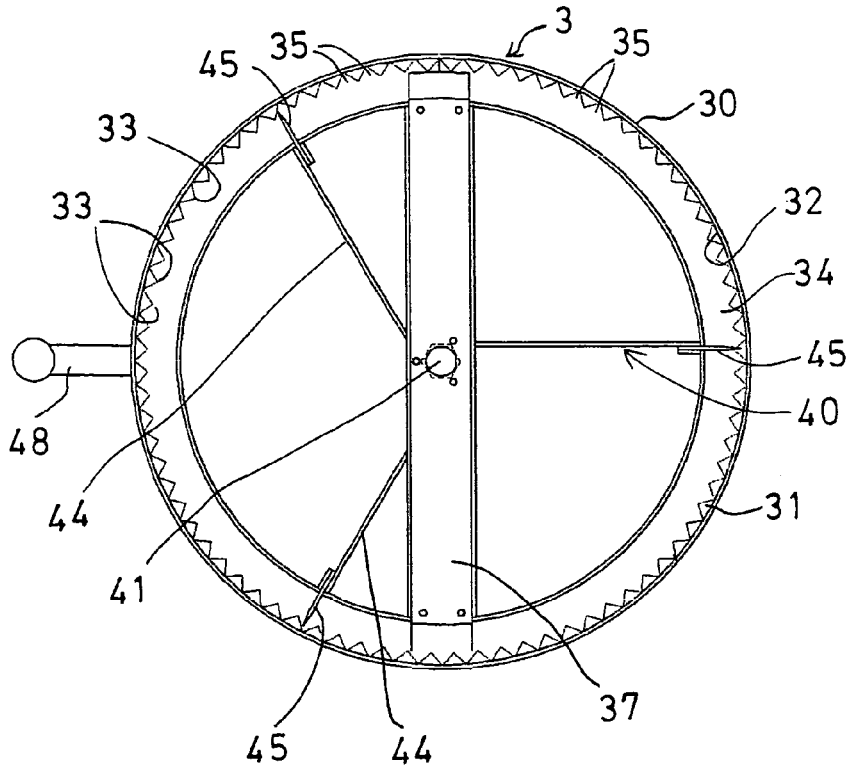
FIG. 4 is a bottom plan view of the filter device for the vacuum collector.
Figure 5:
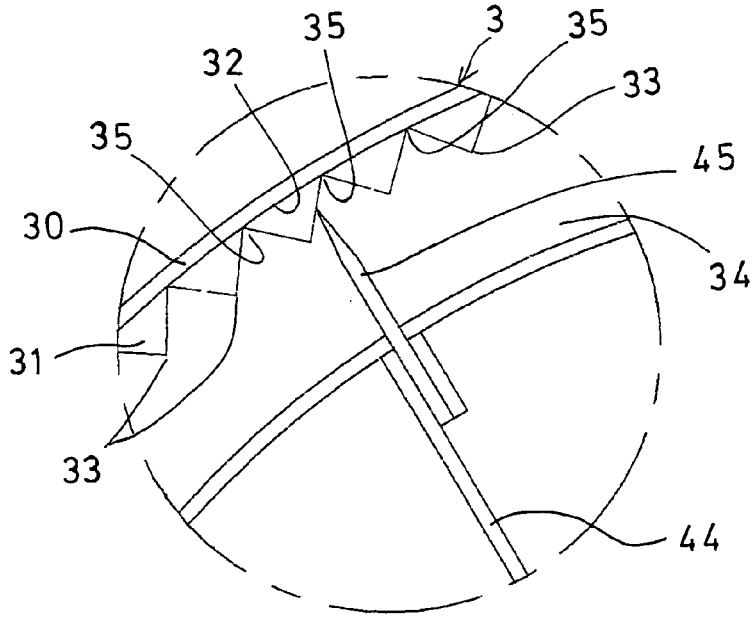
FIG. 5 is an enlarged partial bottom plan view of the filter device.

As shown in FIGS. 2-5, the filter member 31 is disposed in the filter housing 30, and preferably snugly fitted within the filter housing 30, or contacted with an inner peripheral surface 32 of the filter housing 30, best shown in FIGS. 4 and 5. It is preferable that the filter member 31 includes a serrated structure having a number of cusps 33 formed therein and extended inwardly into an inner chamber 34 of the filter member 31, and having a number of recesses 35 formed or defined between the cusps 33.

The filter housing 30 includes an upper panel 36, and includes a bar 37 attached to the bottom portion thereof, and includes two hubs or seats 39 attached to the upper panel 36 and the bar 37 respectively. The sweeping device 40 includes a shaft 41 rotatably disposed in the filter member 31 and in the filter housing 30, and the shaft 41 includes two ends rotatably secured to the seats 39 with such as bearings 42 or the like.

It is preferable that the shaft 41 includes a non-circular cross section, such as a triangular cross section, a square or rectangular cross section, a hexagonal cross section as shown in dotted lines in FIG. 4, or the like, such that the shaft 41 may include two or more flat surfaces 43 formed thereon.

The sweeping device 40 further includes one or more flaps 44 secured onto the shaft 41, such as secured onto the flat surfaces 43 of the shaft 41. For example, as shown in FIGS. 2 and 4, when the shaft 41 includes a triangular or a hexagonal cross section having three or six flat surfaces 43 formed thereon, the flaps 44 may be secured onto the shaft 41 and arranged to have a 120° included angle formed therebetween.

The sweeping device 40 further includes one or more blades 45 of such as rubber or resilient materials secured to the free ends of the flaps 44 with such as fasteners 46, for engaging with the filter member 31, such as for engaging with the cusps 33 of the filter member 31, in order to stir or to sweep off the dust or the dirt that may be attached onto the filter member 31, and thus for allowing the dust or the dirt to be collected within the dust bag 20.

Figure 2:
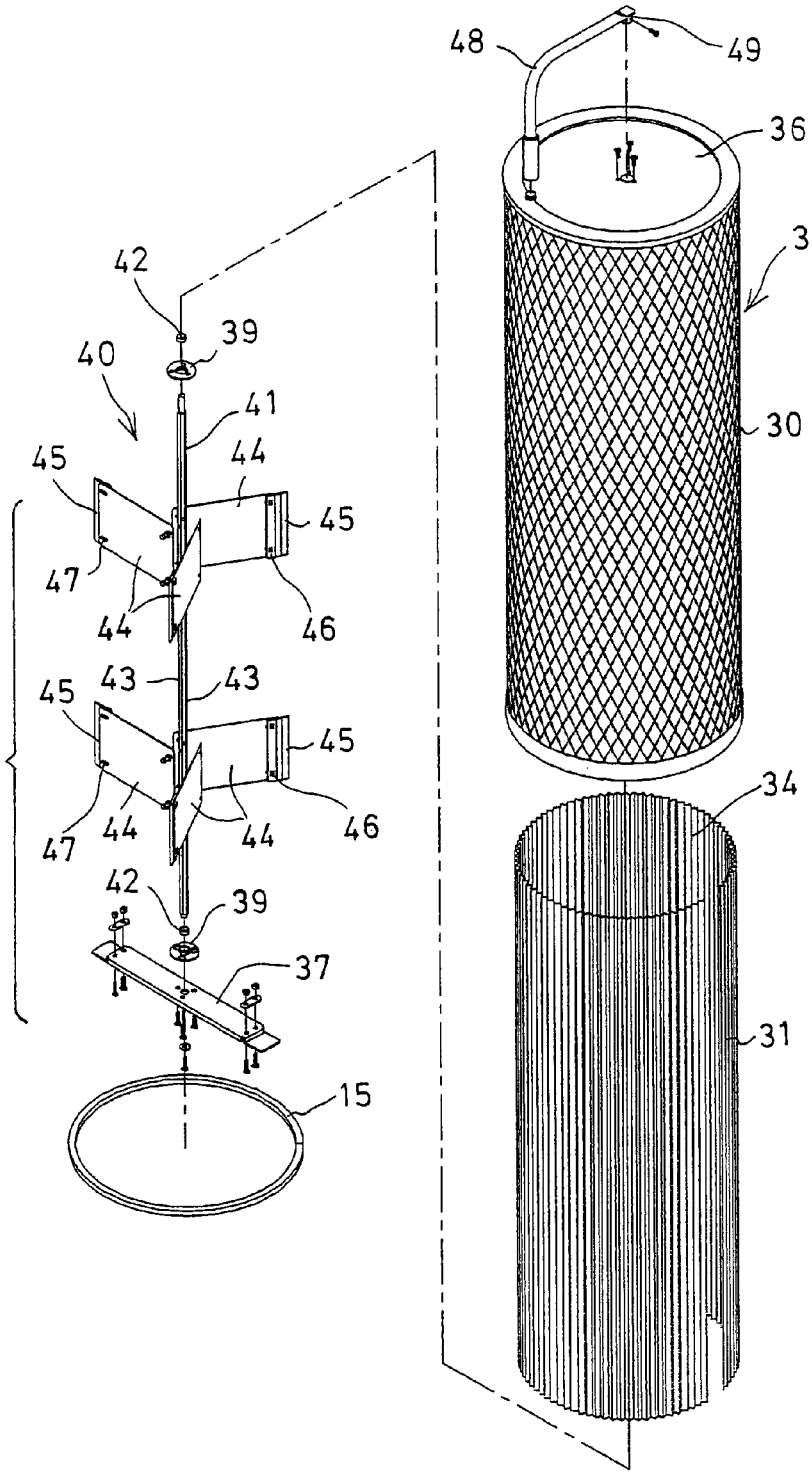
FIG. 2 is an exploded view of a filter device for the vacuum collector.
Figure 3:
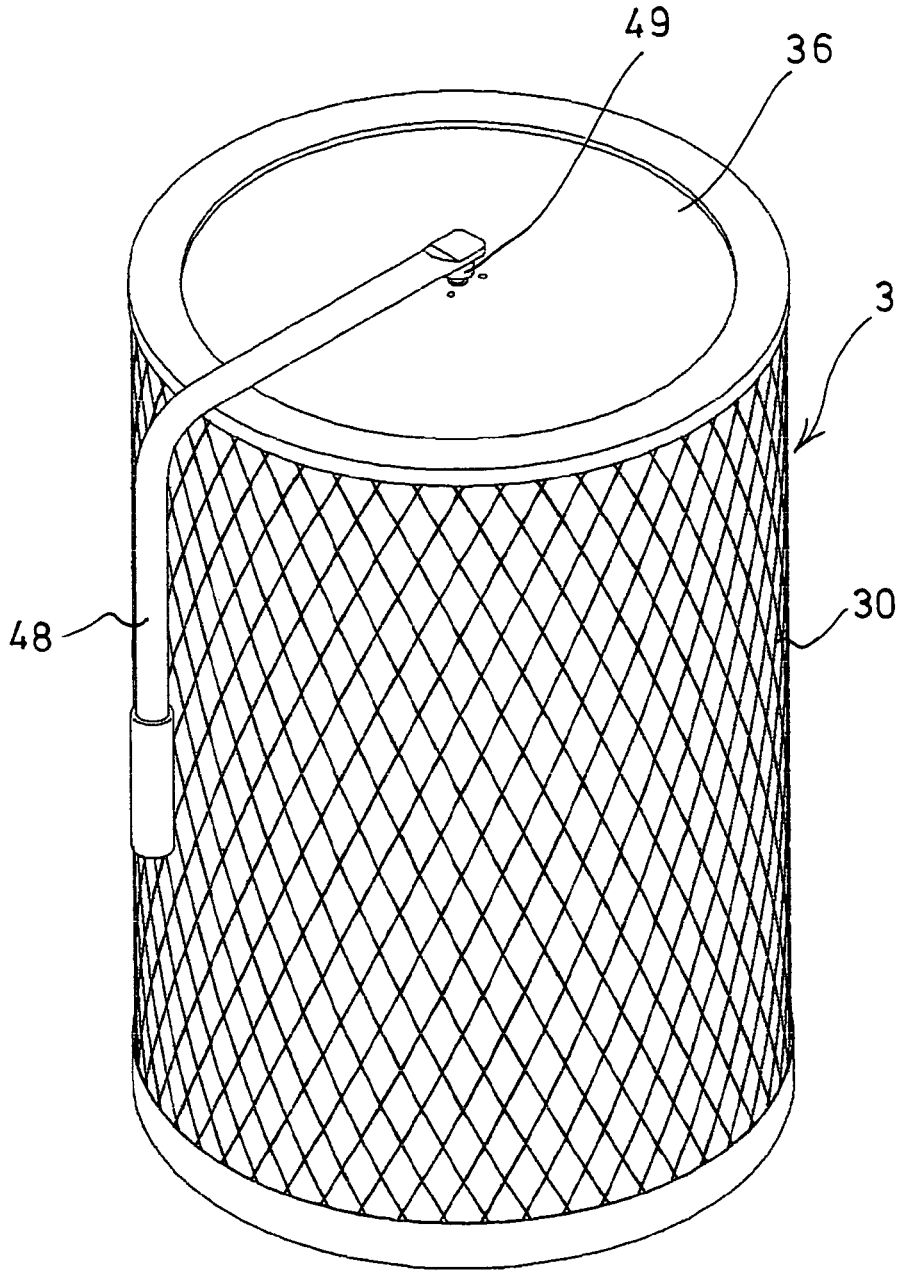
FIG. 3 is a perspective view of the filter device for the vacuum collector.
Figure 6:
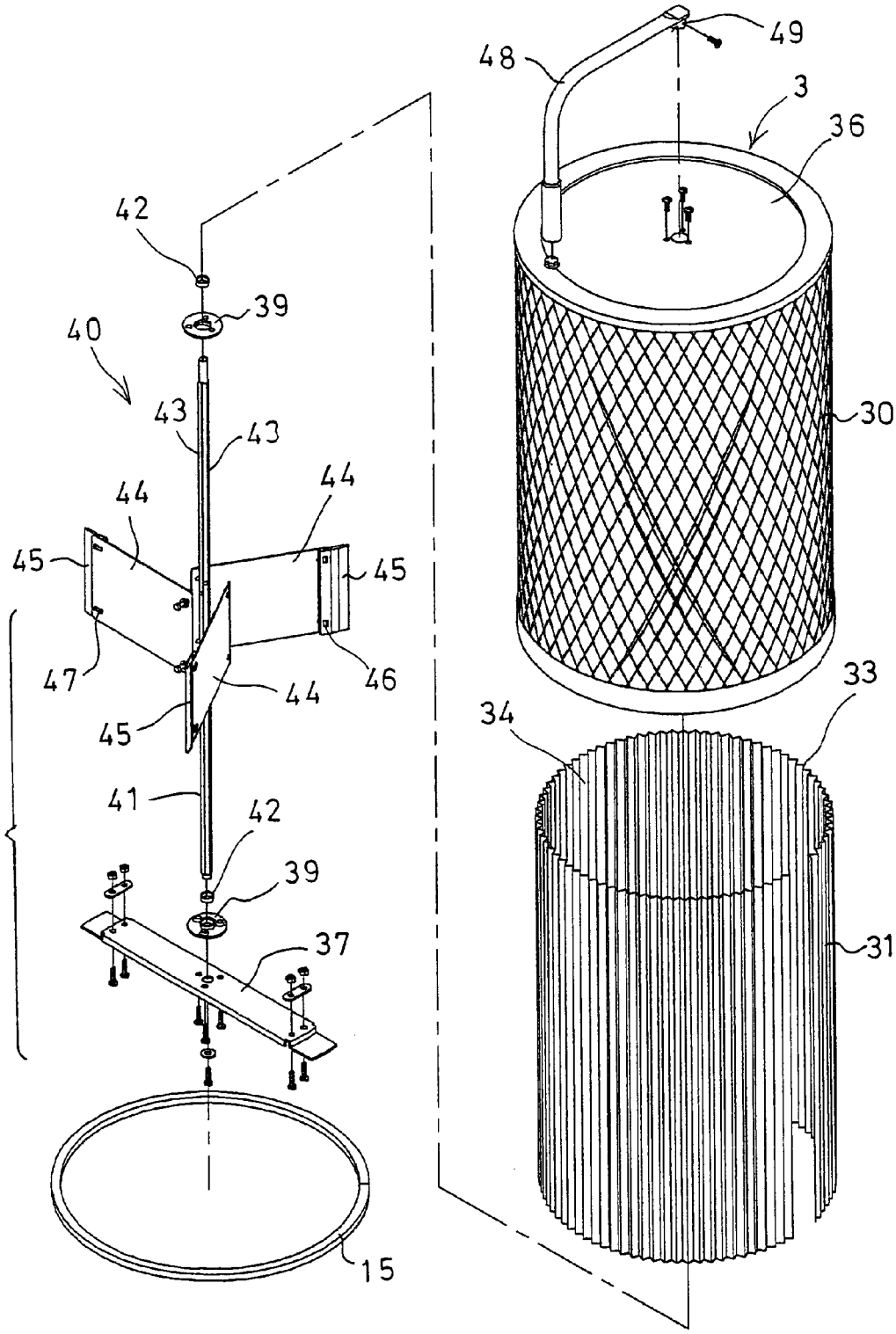
FIG. 6 is an exploded view similar to FIG. 2, illustrating the other arrangement of the vacuum collector.

As shown in FIGS. 2 and 6, each of the flaps 44 may include one or more oblong holes 47 formed therein, for slidably or adjustably receiving the fasteners 46, and thus for allowing the blades 45 to be slightly adjusted toward or away from the flaps 44 respectively, in order to adjust the contacting or the engagement of the resilient blades 45 with the filter member 31, and thus for allowing the resilient blades 45 to effectively sweep the dust or the dirt from the filter member 31.

As also shown in FIG. 2, the sweeping device 40 may include one or more flaps 44 secured onto the shaft 41, and one or more further flaps 44 secured onto the shaft 41 and disposed above or below the other flaps 44, when the filter member 31 includes a greater length or height that may not be effectively contacted or swept by the flaps 44 disposed on a predetermined height relative to the filter member 31.

As shown in FIG. 6, when the filter member 31 includes a shorter length or height, the flaps 44 that are disposed on a predetermined height relative to the filter member 31 may be good enough to effectively contact or sweep the filter member 31, and to remove the dust and the dirt from the filter member 31. It is to be noted that the flaps 44 themselves may also be made of rubber or resilient materials for resiliently engaging with the filter member 31.

A handle 48 may include one end 49 secured to one end of the shaft 41, in order to rotate the shaft 41 and thus the flaps 44 and the blades 45 relative to the filter member 31, in order to remove the dust and the dirt from the filter member 31. When three flaps 44 and three blades 45 are secured to the shaft 41 and spaced for 120° away from each other, it is only required to rotate the handle 48 for 120° relative to the filter member 31, and to sweep the filter member 31 for one circle.

Accordingly, the vacuum collector in accordance with the present invention includes a stirring or sweeping device disposed in a screen filter member, for sweeping dirt from the screen filter member and for allowing the dirt to be easily collected.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A vacuum collector comprising:

a filter housing, a filter member disposed in said filter housing, means for sweeping said filter member, to sweep off dirt from said filter member, said sweeping means including at least one flap rotatably disposed in said filter member for engaging with said filter member to sweep off dirt from said filter member when said at least one flap is rotated relative to said filter member, at least one blade attached to said at least one flap, for engaging with said filter member, and means for adjusting said at least one blade relative to said at least one flap.

2. The vacuum collector as claimed in claim 1, wherein said filter housing includes a shaft rotatably disposed therein to support said at least one flap.

3. The vacuum collector as claimed in claim 2, wherein said filter housing includes an upper panel and a bottom bar, said shaft is rotatably disposed between said upper panel and said bar of said filter housing.

4. The vacuum collector as claimed in claim 2, wherein said shaft includes a non-circular cross section having at least one flat surface formed thereon to attach said at least one flap.

5. The vacuum collector as claimed in claim 1, wherein said adjusting means includes at least one oblong hole formed in said at least one flap, and a fastener adjustably engaging through said at least one oblong hole of said at least one flap, and engaged with said at least one blade, to adjustably secure said at least one blade to said at least one flap.

6. The vacuum collector as claimed in claim 1 further comprising a duct, said filter housing being disposed on said duct, and a vacuum pump coupled to said duct for drawing the dirt into said filter housing via said duct.

7. The vacuum collector as claimed in claim 6 further comprising a dust bag attached to said duct and disposed below said filter housing to collect the dirt.

8. A vacuum collector comprising:

a filter housing including an upper panel and a bottom bar, and including a shaft rotatably disposed between said upper panel and said bar of said filter housing, a filter member disposed in said filter housing, means for sweeping said filter member, to sweep off dirt from said filter member, said sweeping means including at least one flap rotatably disposed in said filter member for engaging with said filter member to sweep off dirt from said filter member when said at least one flap is rotated relative to said filter member, said at least one flap being supported on said shaft of said filter housing, and said filter housing including two seats attached to said upper panel and said bottom bar to rotatably support said shaft between said upper panel and said bar of said filter housing.

* * * * *